US007346966B2

(12) United States Patent
Atkins et al.

(10) Patent No.: US 7,346,966 B2
(45) Date of Patent: Mar. 25, 2008

(54) FITTING FOR A HARNESS

(75) Inventors: Steven R. Atkins, Essex (GB); John Robert Owen, Essex (GB)

(73) Assignee: RWO (Marine Equipment) Ltd., Benfleet, Essex (GB)

( * ) Notice: Subject to any disclaimer, the term of this patent is extended or adjusted under 35 U.S.C. 154(b) by 36 days.

(21) Appl. No.: 10/784,137

(22) Filed: Feb. 20, 2004
(Under 37 CFR 1.47)

(65) Prior Publication Data

US 2005/0115519 A1 Jun. 2, 2005

(30) Foreign Application Priority Data

Feb. 21, 2003 (GB) ..... 0304041.7
Apr. 11, 2003 (GB) ..... 0308440.7

(51) Int. Cl.
*A44B 11/26* (2006.01)

(52) U.S. Cl. ..... 24/635; 24/607; 114/39.18

(58) Field of Classification Search ..... 24/606–608, 24/634, 635; 114/39.18; 403/322.2
See application file for complete search history.

(56) References Cited

U.S. PATENT DOCUMENTS

| | | | | |
|---|---|---|---|---|
| 2,693,980 | A * | 11/1954 | Heidman, Jr. | 294/82.28 |
| 3,188,707 | A * | 6/1965 | Schmidt | 24/310 |
| 3,473,201 | A * | 10/1969 | Hopka et al. | 24/632 |
| 4,112,865 | A * | 9/1978 | Carn | 114/39.18 |
| 4,140,205 | A * | 2/1979 | Matson | 182/3 |
| 4,184,783 | A | 1/1980 | Hall | |
| 4,378,614 | A * | 4/1983 | McKenney | 441/75 |
| 4,452,161 | A * | 6/1984 | McCoy | 114/39.18 |
| 4,540,218 | A * | 9/1985 | Thomas | 297/467 |
| 4,754,532 | A | 7/1988 | Thomson et al. | |
| 5,924,522 | A | 7/1999 | Ostrobrod | |
| 6,293,215 | B1 | 9/2001 | Moorrees | |
| 6,640,397 | B1 * | 11/2003 | Gipson | 24/191 |

FOREIGN PATENT DOCUMENTS

| | | | |
|---|---|---|---|
| DE | 2930598 | | 2/1981 |
| DE | 2930598 | A * | 2/1981 |
| EP | 0 412 942 | A1 | 2/1991 |
| FR | 2373 295 | | 7/1978 |
| FR | 2 744 419 | A1 | 8/1997 |

(Continued)

OTHER PUBLICATIONS

International Search Report dated Jun. 3, 2004.

*Primary Examiner*—James R. Brittain
(74) *Attorney, Agent, or Firm*—Fulwider Patton LLP

(57) ABSTRACT

A fitting for a harness, such as a trapeze harness for a sailboat is disclosed. The fitting comprises: a first part secured to or securable to a harness, a second part connectable to a tether, and a mechanism to releasably inter-connect the first and second parts. The mechanism comprises a plurality of locking members each having a rounded or tapered locking part, configured to be received within a respective locking aperture located on the second part. A locking element is provided which is moveable between a locking position and a release position and is configured to urge each locking member into a position in which its locking part is received within a respective locking aperture when the locking element is in the locking position. This enables the first part and the second part to be releasably locked together.

2 Claims, 12 Drawing Sheets

FOREIGN PATENT DOCUMENTS

| | | | | |
|---|---|---|---|---|
| GB | 2104952 | | | 3/1983 |
| GB | 2104952 | A | * | 3/1983 |
| GB | 2170260 | A | | 7/1986 |
| GB | 2325959 | A | | 12/1998 |
| GB | 2334299 | A | | 8/1999 |
| GB | 2378149 | A | * | 2/2003 |
| WO | WO 8200448 | | | 2/1982 |

* cited by examiner

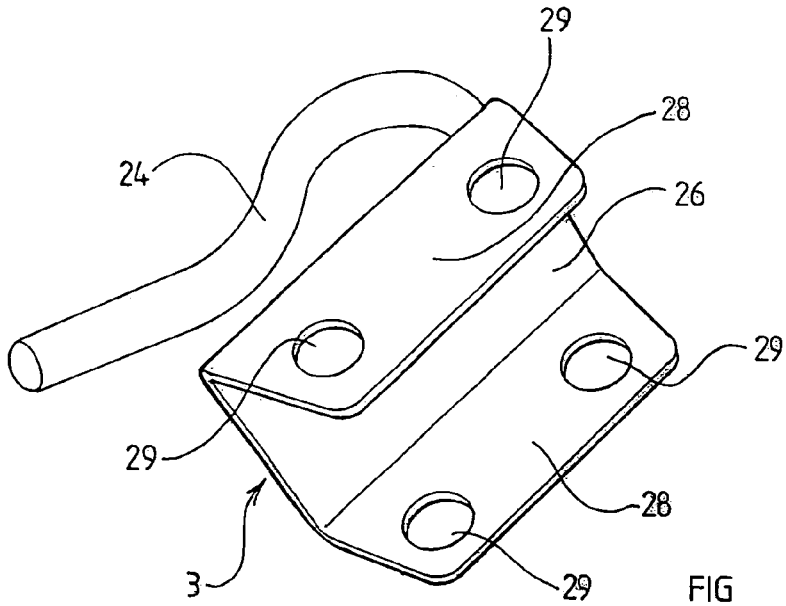
FIG 4
FIG 5
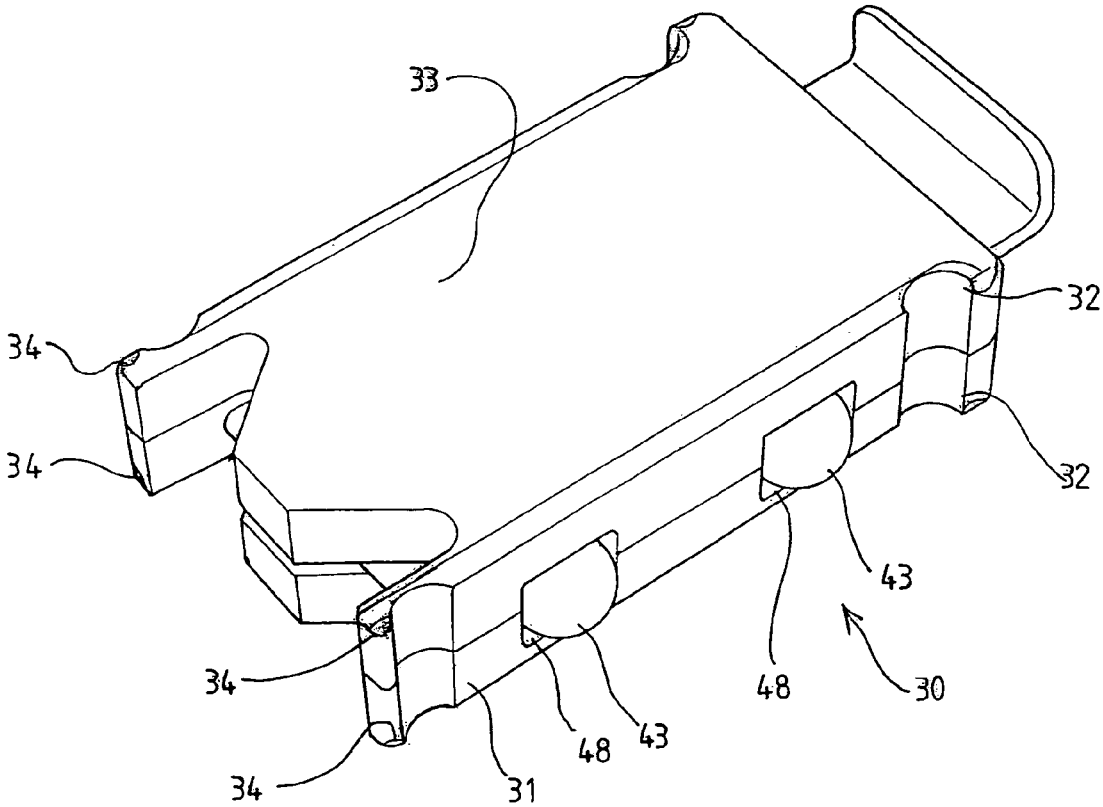

FITTING FOR A HARNESS

RELATED APPLICATIONS

This application claims priority from British patent applications GB 0308440.7 filed Apr. 11, 2003, and GB 0304041.7 filed Feb. 21, 2003.

THE PRESENT INVENTION relates to a fitting for a harness. More particularly, the present invention is directed towards a fitting secured to or securable to a harness, and being connectable to a tether.

Harnesses configured to be worn around the body of a person, and being connectable to the end of a tether are well known. Harnesses of this general type are often used in a wide range of sports or outdoor pursuits. One particular area in which harnesses of this type are often used is in the sport of sailing.

It is important when sailing a sail boat for the crew of the boat to position their weight appropriately in order to balance the heeling force of the wind acting upon the sails of the boat. This is important not only to prevent the boat from capsizing, but also to ensure that the boat is sailing with its mast as close to the vertical position as possible to ensure that the hull of the boat is working efficiently through the water.

As will be appreciated, in windy conditions it is therefore important for the crew of a sail boat to position their weight as far outboard as possible in order to maximise the righting moment of their body weight. It is therefore common in smaller sail boats such as high performance dinghies and small catamarans to use a "trapeze" arrangement in order to position the body weight of one or more crew members as far outboard as practicable. A "trapeze" arrangement essentially comprises a tether in the form of a length of wire or rope anchored to the mast of the sail boat at a position spaced significantly above the foot of the mast. The tether line, or "trapeze wire" as it is commonly known, carries a loop of any convenient shape at its lowermost end. A crew member using a trapeze wire wears a body harness which is typically provided with a downwardly turned hook, although an upwardly turned hook is equally possible. The hook is provided at the front of the harness in the waist region of the harness and is configured to hook onto the loop carried by the lowermost end of the trapeze wire. The crew member is therefore able to attach the lower end of the trapeze wire to his or her trapeze harness using the downwardly turned hook, and thereafter move to a position in which he or she effectively hangs from the trapeze wire with his or her feet bearing against the gunwhale of the boat or against an outermost surface of a rack of wing extending outboard from the gunwhale. A person "trapezing" in this manner typically adopts a "standing" position in which his or her body extends outboard from the surface against which his or her feet are resting. Of course, it is equally possible for the hook to be provided on the end of the trapeze wire, and for the loop to be provided on the harness.

In order to ensure a secure connection between the trapeze wire and the harness to prevent accidental disengagement, the hook provided on the above-mentioned type of harness is fixed with respect to the body of the harness in order to prevent inadvertent unhooking of the trapeze wire.

It has been found that known trapeze harness arrangements of the general type described above can suffer from disadvantages, particularly where the crew member wishes to unhook the trapeze wire from their harness in an emergency. Because of the nature of the types of sail boats which use trapeze arrangements, the boats can be unstable and/or can travel at considerable speed. It is not uncommon for these type of boats to capsize or change attitude very quickly. It has therefore been found that in some instances of capsize or other violent movements, trapezing crew members can become trapped against the rigging of the boat or become trapped under the hull or sails of the boat when capsized. There have been instances where crew members trapped in such positions have been unable to unhook their harnesses from the trapeze wires, therefore preventing easy escape.

It is therefore an object of the present invention to provide an improved fitting for a harness and a harness provided with such a fitting. However, whilst the arrangement of the present invention is particularly suitable for use with trapeze harnesses in the sport of sailing, it should be appreciated that the invention can also find application in many other areas where a harness is worn such as, for example, kite-surfing, wind-surfing, paragliding, mining, pot-holing, window cleaning and forestry.

According to a first aspect of the present invention, there is provided a fitting for a harness, the fitting comprising: a first part secured to or securable to a harness, a second part connectable to a tether, and a mechanism to releasably interconnect the first and second parts, one of said parts having a plurality of locking apertures or recesses and said mechanism comprising: a plurality of locking members each having a rounded or tapered locking part sized to be received within a respective said locking aperture or recess; and a locking element moveable between a locking position and a release position, the locking element being configured to urge each locking member into a position in which its locking part is received within a respective said locking aperture or recess when in said locking position but to allow each locking member to move out of said respective locking aperture or recess when in said release position.

Preferably each said locking member is constrained for linear movement towards and away from each respective locking aperture or recess.

Preferably, said locking element is biased towards said locking position.

Conveniently, said locking element is biased by a spring.

Advantageously, each said locking aperture or recess defines a respective peripheral seat, and the rounded or tapered locking part of each said locking member is sized to engage a respective said seat when urged into said respective locking aperture or recess but not to pass completely through said seat.

Preferably, each said peripheral seat is substantially circular.

Conveniently each said locking member is a ball.

Preferably, each locking member is provided in a linear channel to restrict the locking member to substantially linear movement.

Advantageously, said locking element is arranged for movement between said locked and release positions along an axis substantially perpendicular to the axis of each said channel.

Conveniently, said locking element has a respective bearing surface to bear against each said locking member when the locking element is in said locking position, and a respective recess to receive each said locking member when the locking element is in said release position.

Preferably, said locking apertures or recesses are provided in said second part, and said locking members and said locking element are provided on said first part.

Advantageously, each said locking member is held captive between said locking element and a respective retaining aperture formed in said first part, each said retaining aperture being sized to prevent the respective locking member from passing completely therethrough, whilst allowing the respective locking member to project sufficiently therethrough to engage a respective seat defined on the second part.

Conveniently, each said retaining aperture is substantially circular and has a smaller diameter than each said seat.

Preferably, said second part has a hook for connection to said tether. However, other types of connection are also possible.

Alternatively, said second part has a loop for connection to said connection to said tether.

Advantageously, the fitting has an actuator button configured to urge said locking element towards said release position when pressed or pulled.

Conveniently, said actuator button is formed as part of said locking element.

Preferably, the fitting comprises a guard arrangement configured to extend at least partly around said actuator button to prevent the button from being accidentally pressed.

Advantageously, said plurality of locking apertures or recesses comprise at least one pair of opposed locking apertures or recesses.

Conveniently, the fitting comprises a plurality of said pairs of locking apertures or recesses and a plurality of respective pairs of locking members.

Preferably, wherein the locking element is arranged to urge the locking members of the or each said pair of locking members apart from one another into said respective locking apertures or recesses.

Preferably, each said interlocking aperture or recess is provided at a position adjacent at least one other said locking aperture or recess.

Advantageously, said locking apertures or recesses are all aligned with one another.

Conveniently, a plurality of locking apertures are provided through a plate carried by said second part.

Preferably, the locking element is arranged to urge at least two of said locking members towards one another in order that their locking parts become received within respective said locking apertures or recesses.

Advantageously, three locking apertures or recesses are provided, and three locking members are provided, two of said locking members being arranged to move in the same direction as one another towards respective locking apertures or recesses.

Conveniently, the locking element is arranged to urge at least two of said locking members in the same direction as one another in order that their locking parts become received within respective said locking apertures or recesses.

According to another aspect of the present invention, there is provided a harness having a fitting as defined above.

So that the invention may be more readily understood, and so that further features thereof may be appreciated, embodiments of the invention will now be described, by way of example, with reference to the accompanying drawings, in which:

FIG. 4 is a perspective view from behind of one of the parts illustrated in FIG. 3;

FIG. 5 is a perspective view of a locking mechanism of the fitting;

Figure 1:
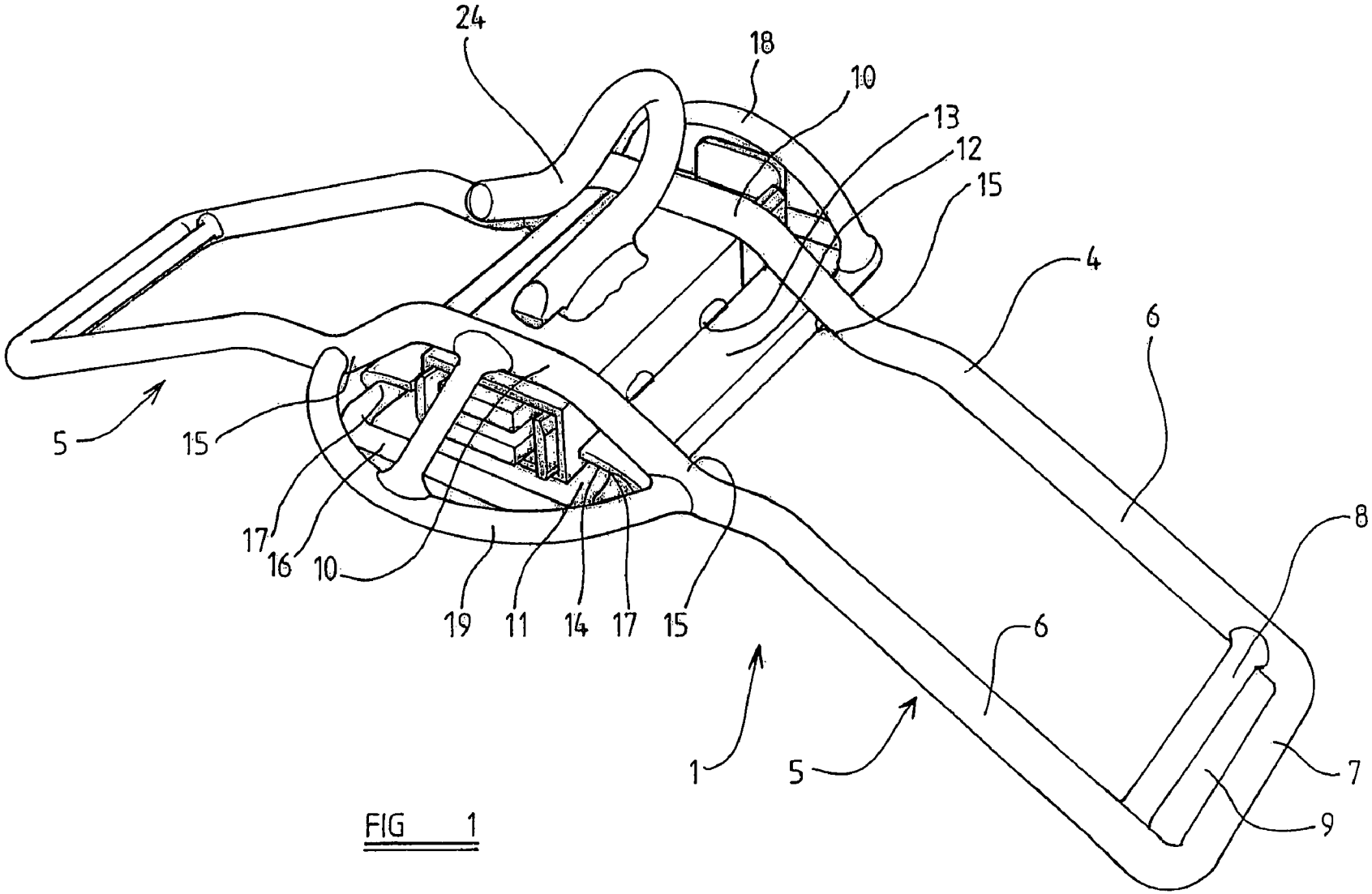
FIG. 1 is a perspective view from the front and below of a fitting in accordance with a first embodiment of the present invention for attachment to a harness.
Figure 2:
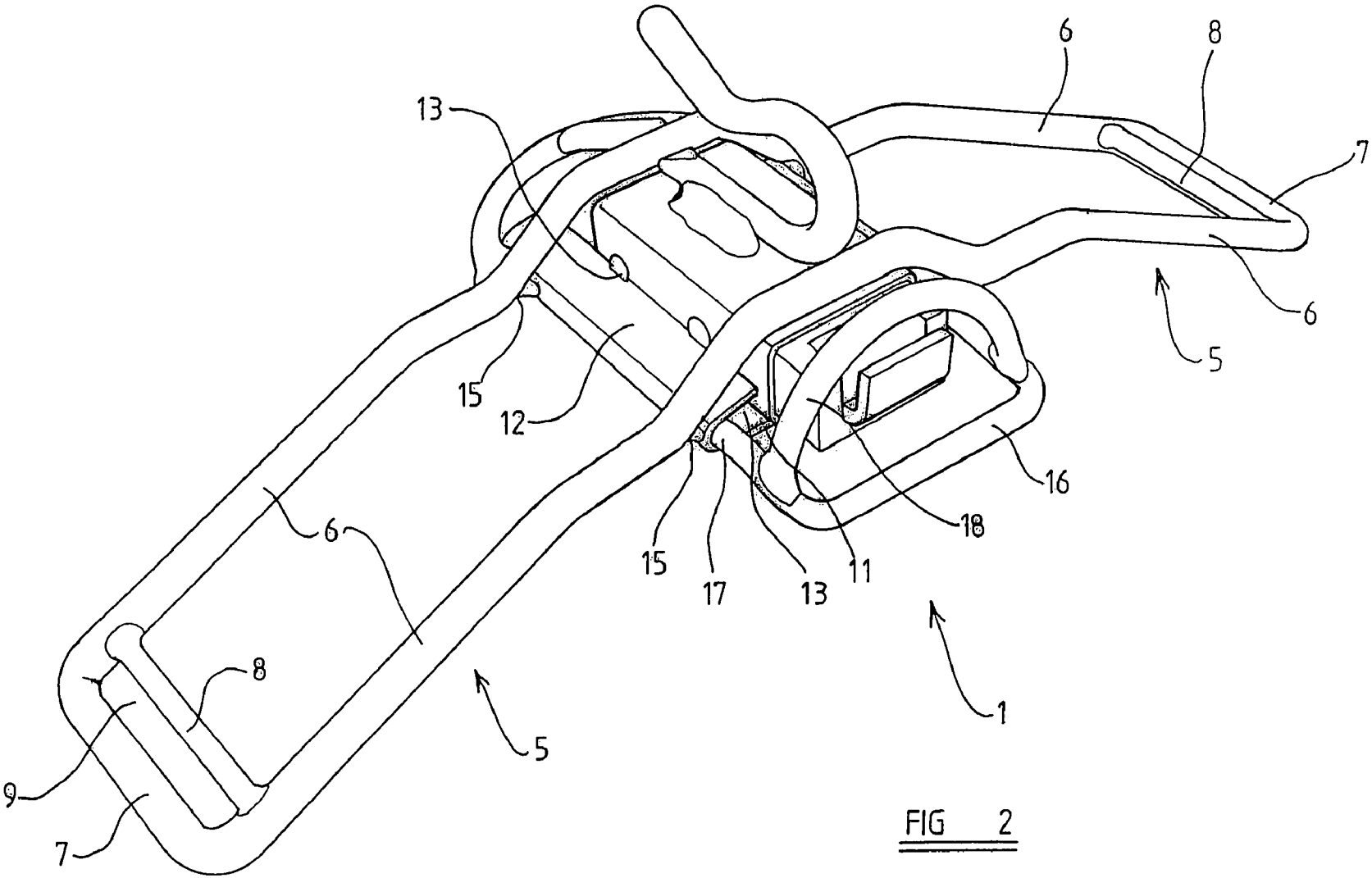
FIG. 2 is a perspective view from above and the front of the fitting illustrated in FIG. 1.
Figure 3:
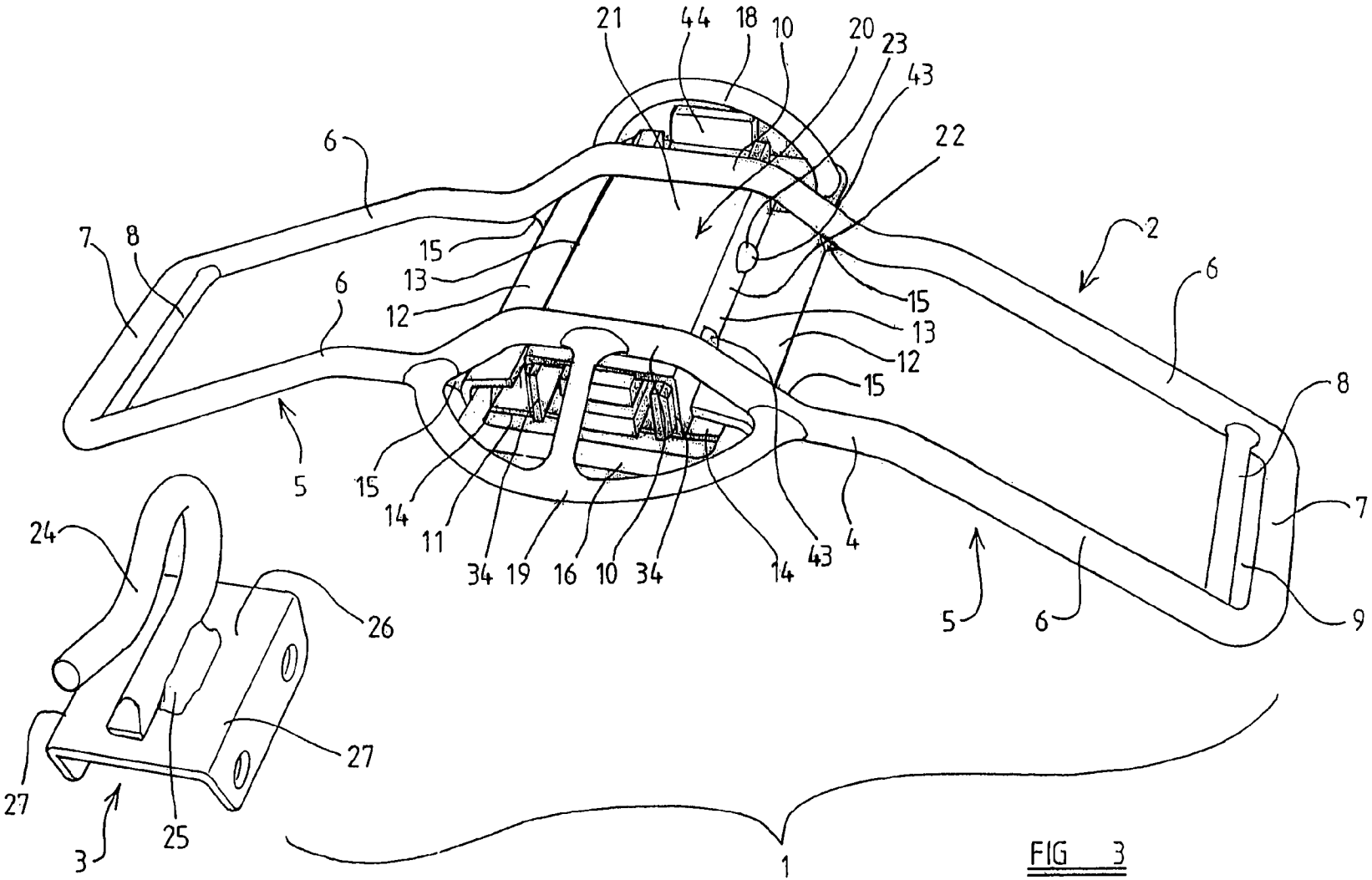
FIG. 3 is a view corresponding generally to that of FIG. 1, but illustrating two connectable parts of the fitting separated from one another.

With reference to FIGS. 1 to 3, there is illustrated a fitting 1 in accordance with the present invention. As will be apparent from FIG. 3 in particular, the fitting 1 comprises two main parts 2,3 which are releasably connectable to one another. FIG. 3 illustrates the two main parts 2,3 in a condition in which they are released and separate from one another, whilst FIGS. 1 and 2 illustrate the two main parts 2,3 connected to one another.

The first part 2 of the fitting comprises an elongate frame 4 which is bent from a length of rigid metal bar. The frame 4 defines a pair of rearwardly directed arms 5, each of which has a generally rectangular configuration and comprises a pair of rearwardly directed bar portions 6 which are interconnected by a terminal bar portion 7. Spaced slightly inwardly from each terminal bar portion 7, there is provided a securing bar 8 which extends between the two bar portions 6 of each arm 5. Each securing bar 8 is welded at each end to a respective bar portion 6. An elongate slot 9 is thus defined between the terminal bar portion 7 and the securing bar 8 of each arm 5.

The central region of the frame 4 comprises a pair of central bar portions 10, each of which extends between a bar portion 6 of each arm 5.

The frame 4 defining the two arms 5 is mounted centrally on a base plate 11 which is generally square or rectangular, but which has two opposed side regions bent inwardly to define a pair of inwardly directed flanges 12. Each flange 12 has a linear inner edge 13 and defines a respective elongate channel 14 between itself and the rear part of the base plate 11. The frame 4 is secured to the base plate 11 by four welds 15 in the regions of the ends of each inwardly directed flange 12.

A smaller rectangular frame 16 is mounted to the base plate 11, and is oriented such that its longitudinal axis is generally perpendicular to the longitudinal axis of the frame 4 defining the pair of arms 5. The smaller frame 16 is mounted to the base plate 11 such that its two longitudinal bar portions 17 are each received within a respective channel 14 defined by the inwardly directed flanges 12. The smaller frame 16 is again welded to the base plate. As illustrated most clearly in FIG. 2, the top region of the frame 16 is provided with a forwardly extending arcuate loop 18 which is welded to and extends between the two longitudinal bar portions 17 of the smaller frame 16. A similar loop 19, having a larger radius of curvature, is provided to extend downwardly from the frame 4 in the region of the base plate 11.

Secured, again by welding, to the base plate 11, between the two inwardly turned flanges 12, is an elongate channel 20 of substantially rectangular cross section. The channel 20 comprises a front wall 21 and a pair of side walls 22. Each side wall 22 extends forwardly from the base plate 11 at a position spaced slightly inwards from the longitudinal edge 13 of a respective flange 12. Each side wall 22 is provided with two-spaced apart circular retaining apertures 23 (FIG. 3), the purpose of which will become clear hereinafter.

The rectangular channel 20 encloses a locking mechanism which will be described in more detail hereinafter.

Having regard to FIGS. 3 and 4, it will be seen that the second part 3 of the fitting 1 comprises a hook 24 bent from a length of metal bar and secured, by a weld 25, to a rectangular flat plate 26. From each longitudinal edge 27 of the plate 26, extends a rearwardly directed side wall 28. The two side walls 28 are parallel with one another and are each provided with two spaced-spaced circular locking apertures 29. The apertures 29 formed through one side wall 28 are each aligned with a respective aperture formed through the opposite side wall 28. The apertures 29 provided through each side wall 28 are spaced from one another by a distance equal to the spacing between the apertures 23 provided to the side walls 22 extending forwardly from the base plate 11. However, the apertures 29 formed to the side walls 28 of the hook part 3 each have a slightly larger diameter than the apertures 22 carried by the first part 2. The edge of each aperture 29 defines a circular seat 29*a*, the purpose of which will become clear hereinafter.

As indicated above, the channel 20 provided on the base plate 11 houses a locking mechanism. The locking mechanism will now be described, in more detail, with reference to FIGS. 5 to 8.

As illustrated in FIG. 5, the locking mechanism 30 takes the form of a generally rectangular cartridge 31 which is sized to be received within the channel 20 as illustrated generally in FIG. 3.

Figure 6:
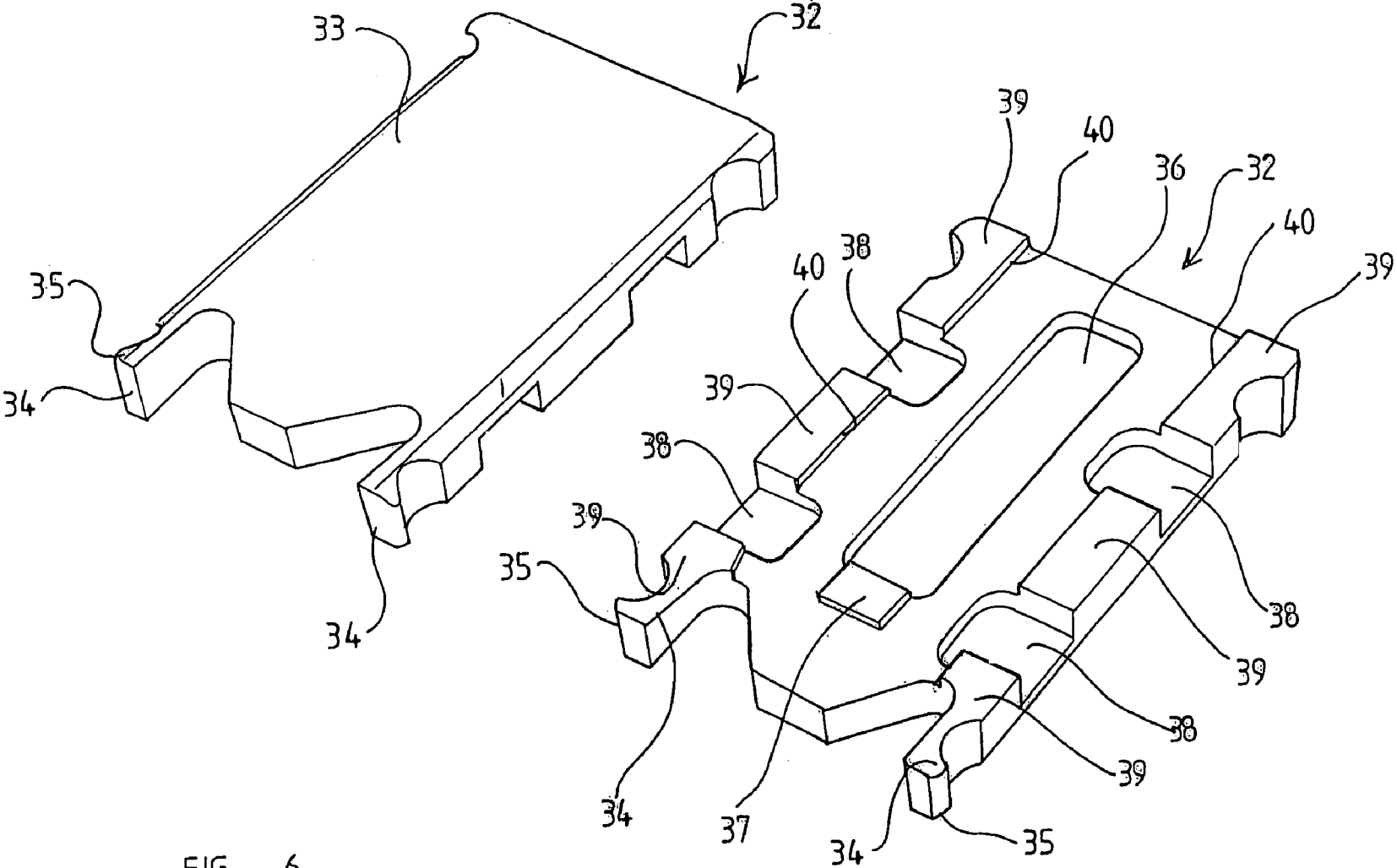
FIG. 6 is a perspective view of two component parts of the locking mechanism illustrated in FIG. 5.

The cartridge 31 comprises a pair of substantially identical plastic mouldings 32, as illustrated in FIG. 6, which define the cartridge 31 when positioned against one another as illustrated in FIG. 5. Each cartridge moulding 32 has generally rectangular configuration and has a planar outer surface 33. From one end of each cartridge moulding 32 extend a pair of resiliently deformable fingers 34, each of which terminates with an outwardly directed projection 35.

As will be seen from the right hand cartridge moulding 32 illustrated in FIG. 6, the inner surface of each cartridge moulding 32 is provided with a centrally located channel 36 of generally rectangular configuration. At one end of the channel 36, there is provided an upwardly extending projection 37. On either side of the channel 36, a pair of spaced apart rectangular recesses 38 are provided, each of which is open at its outermost end.

Along the longitudinal edges of the cartridge moulding 32, there are provided raised regions 39 which are substantially level with the upstanding projection 37. A linear inwardly directed shoulder 40 is defined by the inner surface of each raised portion 39.

Figure 7:
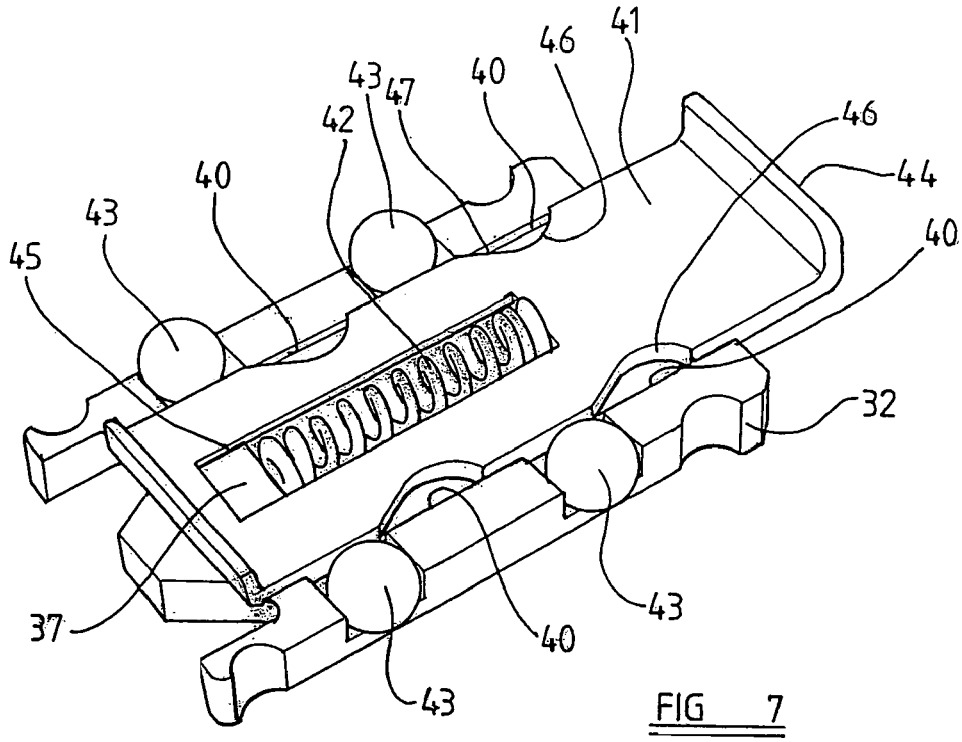
FIG. 7 is a view corresponding generally to that of FIG. 5, but illustrating one component part of the mechanism removed so that the operative parts of the mechanism are visible.
Figure 8:
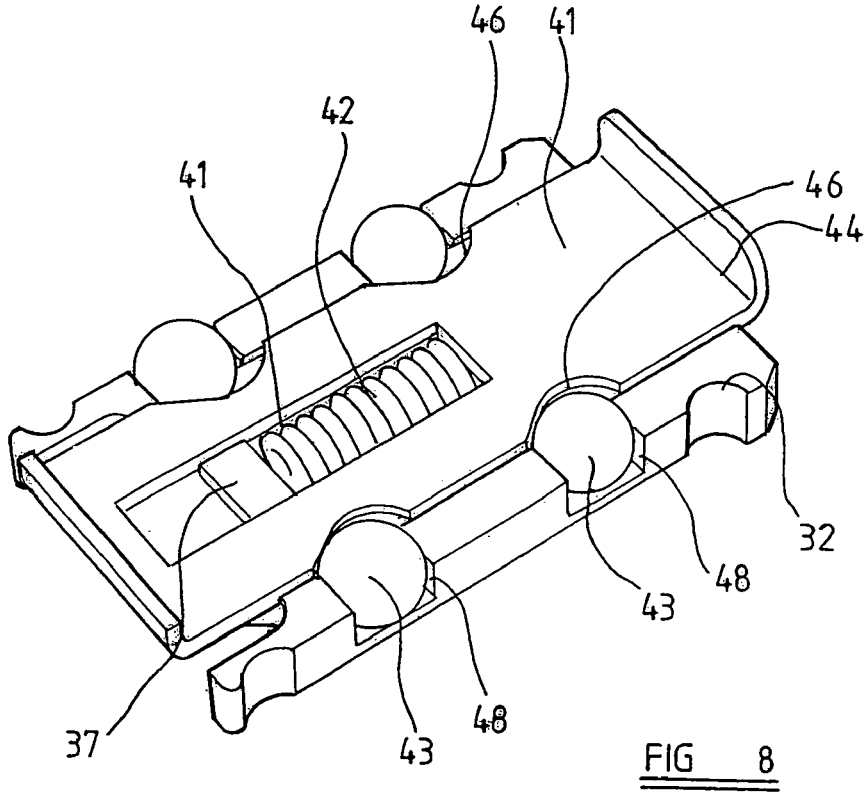
FIG. 8 is a view corresponding generally to that of FIG. 7, illustrating parts of the mechanism in an alternate position.

As illustrated in FIG. 7, the two cartridge mouldings 32 serve to house the operative parts of the mechanism 30 which include a generally rectangular metal locking element 41, a helically wound spring 42, and four locking members which, in the arrangement illustrated, take the form of balls 43.

The locking element 41 is generally planar but is bent forwardly at one end to define a lip 44 which will serve as an actuating button. A rectangular slot 45 is formed through the locking element 41, the width of the slot being sized to receive the projection 37 as a sliding fit. The width of the locking element 41 is such that the locking element 41 as a whole can be mounted on the cartridge moulding 32 illustrated in FIG. 7 so as to be a close sliding fit between the opposed shoulders 40, with the projection 37 received within the slot formed through the locking element 41. With the locking element 41 located with respect to the cartridge moulding 32 such that the projection 37 abuts the ends of the slot 45 spaced furthest from the actuating button 44, the spring 42 can be inserted through the slot 45 and into the channel 36 so as to engage the end of the channel 36 at one end, and the end of the slot 45 proximal to the actuating button 44 at the other end.

As also illustrated in FIG. 7, along each longitudinal edge of the locking element 41, there are provided a pair of recesses 46. Each recess 46 is generally arcuate and is configured to have a ramp surface 47 extending outwardly and away from the actuating button 44, to adjoin the longitudinal edge of the locking element 41.

As clearly illustrated in FIG. 7, each ball 43 is sized to be received within a respective recess 38 provided along the side edges of the cartridge moulding 32. With the locking element 41 urged by the spring 42 towards the locking position as illustrated in FIG. 7, each ball 43 bears against a longitudinal edge surface of the locking element 41.

When the components illustrated in FIG. 7 are assembled as shown, the other cartridge moulding 32 can then be positioned over the first cartridge moulding 32 such that the locking element 41, the spring 42 and the balls 43 are all located between the two cartridge mouldings 32 as illustrated in FIG. 5. When the locking mechanism 30 is assembled as shown in FIG. 5, the two cartridge mouldings 32 can be secured to one another by way of a peg or spigot carried by one moulding 32, which is received within a corresponding aperture provided on the other moulding. Each recess 38 of one cartridge moulding 32 is aligned with a respective recess 38 of the other cartridge moulding 32, hence defining a channel 48 in which each ball 43 is received. However, it should be appreciated that the balls 43 are not, in the configuration illustrated in FIG. 5, held captive within the respective channels 48.

The locking mechanism 30, when assembled as illustrated in FIG. 5 is then inserted into the channel 20 provided on the first part 2 of the fitting 1. The cartridge 31 of the locking mechanism 30 is sized to be a close sliding fit within the channel 20 and so may be inserted into the channel from the top end, underneath the arcuate loop 18. In order to insert the cartridge 31 into the channel 20 in this way, the deformable fingers 34 of each cartridge moulding are depressed inwardly, and the balls 43 must be held in place to prevent them falling out of the open channels 48. When the cartridge 31 is fully inserted into the channel 20, then the resilient fingers 34 are free to move outwardly under their resilience such that the projections 35 engage the lower end of the respective side walls 22, as illustrated in FIG. 3. In this fully inserted position, the actuating button is located generally behind the arcuate loop 18. The loop 18 thus serves as a guard arrangement extending around the actuating button 44 to prevent accidental actuation of the button 44.

As illustrated most clearly in FIG. 3, when the cartridge 31 of the locking mechanism 30 is fully inserted into the channel 20 as described above, the transverse channels 48 of the locking mechanism 30 each become aligned with a respective aperture 23 formed through the side walls 22 projecting forwardly from the base plate 11. The apertures 22 are sized to prevent the balls 43 passing completely therethrough and hence serve to hold the balls 43 captive within their respective channels 48.

The normal position of the operative parts of the mechanism 30 are generally as indicated in FIG. 7, in which the spring 42 urges the locking element 41 into a locking position in which the upstanding projection 37 engages the end of the slot 45 remote from the actuating button 44. In this position, the balls 43 engage an outermost edge surface of the locking element 41 and are urged into the apertures 23 provided to the side walls 22 so as to project outwardly through the apertures 23. However, when the actuating button 44 is depressed, so as to slide the locking element 41 between the two cartridge mouldings 32 towards a release position (only one cartridge moulding 32 being illustrated in FIG. 8 for convenience), against the action of the spring 42, the recesses 46 defined along the longitudinal edges of the locking element 41 each become aligned with a respective ball-receiving channel 48, and hence in this configuration, the balls 43 are each able to move inwardly relative to the cartridge 31, out of engagement with the apertures 23. When the actuating button 44 is subsequently released, the spring 42 urges the locking member 41 back towards the locking position illustrated in FIG. 7 and hence the ramp surfaces 47 of each recess 46 serve to urge the respective balls 43 outwards again towards the position illustrated in FIG. 7, in which, when the cartridge is inserted in the channel 20, each ball 43 is received within a respective aperture 23.

Figure 9:
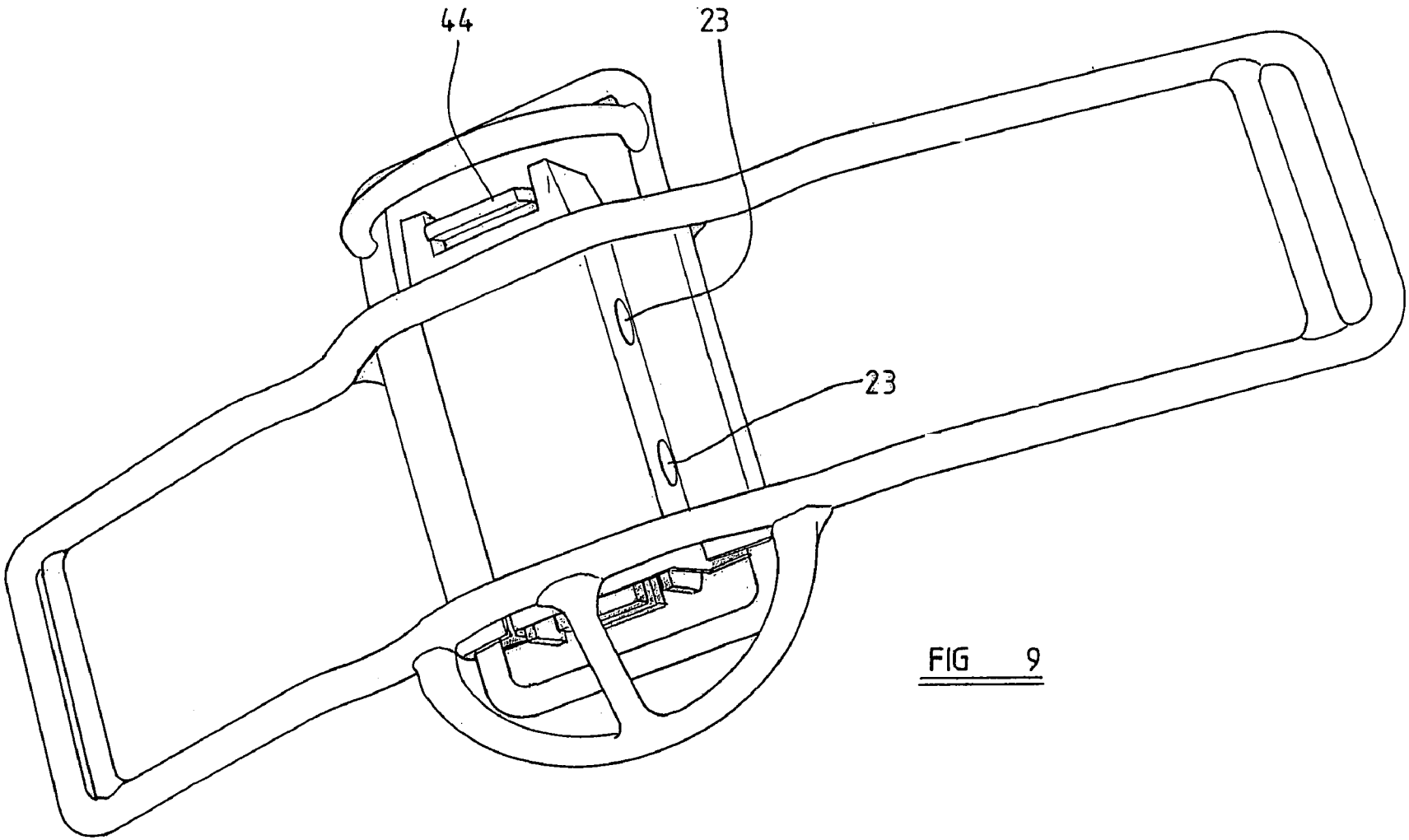
FIG. 9 is a perspective view of the fitting illustrated in FIG. 1, showing the mechanism being actuated.

It will therefore be appreciated that when the locking mechanism 30 is assembled as indicated in FIG. 3, the actuating button 44 can be depressed, as indicated in FIG. 9, and the balls 43 will each be allowed to move inwardly so as to no longer project through the apertures 23. In this condition, the hook part 3 can be mounted on the main part 2 so that the plate 26 of the hook part bears against the front wall 21 of the channel 20. The two rearwardly extending side walls 28 of the hook part each bear against a respective side wall 23 extending forwardly from the base wall 11 and are received between the respective side walls 23 and the inner edge 13 of the adjacent flange portion 12. In this position, the apertures 29 formed through the side walls 28 of the hook part 3 each become aligned with a respective aperture 23 provided on the main part 2. When the actuating button 44 is subsequently released, the balls 43 are driven outwardly so that they project through the apertures 23 and into the apertures 29 formed on the hook part 3. This configuration is illustrated in FIGS. 1 and 2.

Because the apertures 29 of the hook part 3 have a smaller diameter than the apertures 23 of the main part 2, each ball 43 is urged into engagement with a respective peripheral seat 29*a* defined by the apertures 29, and hence serve to lock the hook part 3 to the main part 2 in a substantially rigid manner as illustrated in FIGS. 1 and 2.

The main part 2 of the fitting can be secured to a body harness such as, for example, a trapeze harness or windsurfing harness such that the base plate 11 is located centrally, above the groin region of the harness. The two arms 5 extend outwardly around the waist region of the harness and the slots 9 each allow a respective webbing strap or the like to pass therethrough to provide secure connection of the main part 2 to the harness. When mounted to the harness in this way, the fitting 1 presents the hook 24 in a convenient position to be clipped onto a tether line such as, for example, a trapeze wire.

As described above, the four balls 43 are each driven outwardly into engagement with respective seats 29*a* defined by the apertures 29 on the hook part 3 and hence provide a secure connection between hook part 3 and the main part 2. In this configuration, the fitting 1 can be used to support the weight of a person wearing the harness, when hanging from a tether line clipped onto the hook 24. However, should the person find themselves in difficulty or danger, requiring urgent detachment from the tether, the person can simply depress the actuating button 44 as described above, which allows the four balls to move inwardly, hence moving out of engagement with the peripheral seats 29*a* defined by the aperture 29 as the hook part 3 is pulled away from the main part 2 under the force applied by the tether. The main part 2 of the fitting 1 and the hook part 3 hence become disconnected from one another allowing the person wearing the harness to become released from the tether line in an emergency.

Because the balls 43 each present a rounded part for engagement with the peripheral seats 29*a*, the seats 29*a* are prevented from snagging on the balls as the hook part is pulled away from the main part 2. The seats 29*a* ride smoothly over the rounded surface of the balls 43, therefore ensuring that the balls 43 are properly urged inwardly. However, it should be appreciated that the locking members do not have to take the form of balls but instead could take the form of other convenient shapes such as, for example an elongate spigot having a rounded end surface, or a conical or frustoconical member presenting a tapered locking surface for engagement with the peripheral seats 29*a*.

Whilst the present invention has been described above with reference to a specific embodiment, it should be appreciated that various modifications or alterations could be made to the above-described arrangement, without parting from the scope of the present invention. For example, whilst the above-described arrangement has two pairs of opposed apertures formed on the hook-part 3, it is envisaged that the arrangement could be modified to have only one pair of opposed apertures on the hook-part 3, or even more than two pairs of opposed apertures. Of course, in each of these variants, the two apertures of each pair must each be associated with a respective ball provided in the locking mechanism.

Also, whilst the embodiment described above is provided with locking apertures on the hook-part 3 to define the peripheral seats 29*a*, the apertures could be replaced with recesses defining the peripheral seats 29*a*, in which case the balls 43 would each be received in a respective said recess when engaging said peripheral seat, so as not to be visible when the hook-part 3 is connected to the main part 2 of the fitting 1.

Figure 10:
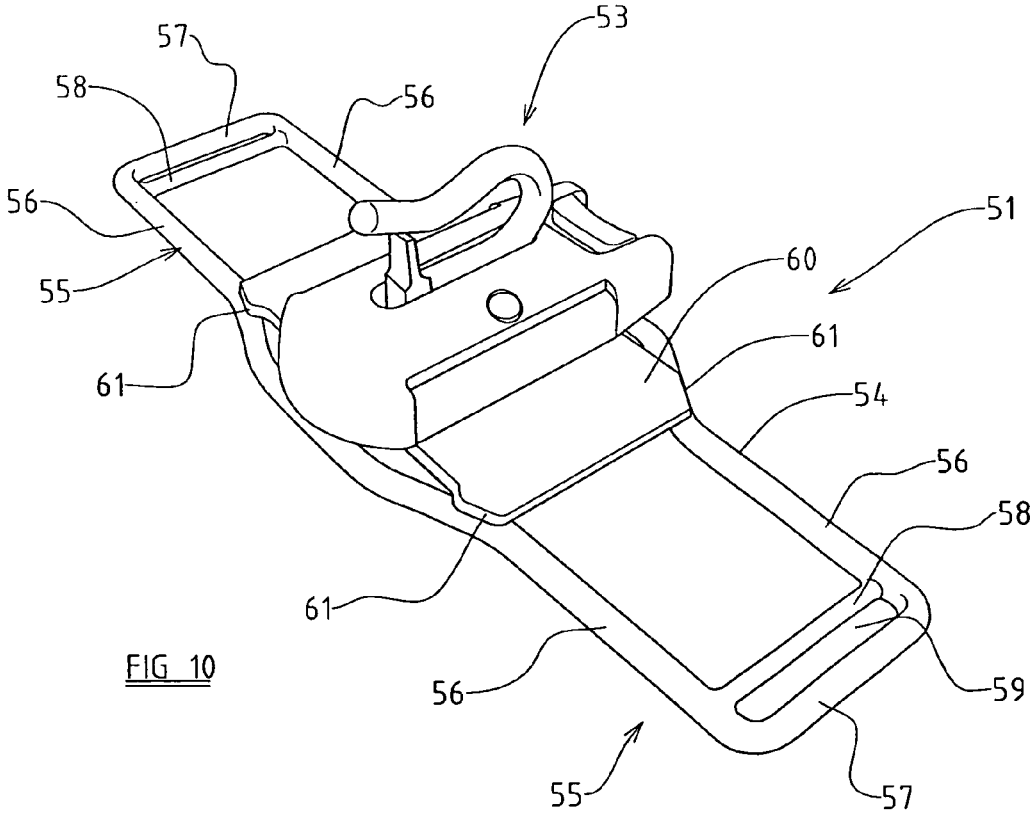
FIG. 10 is a perspective view from the front and below of a fitting in accordance with a second embodiment of the present invention for attachment to a harness.
Figure 11:
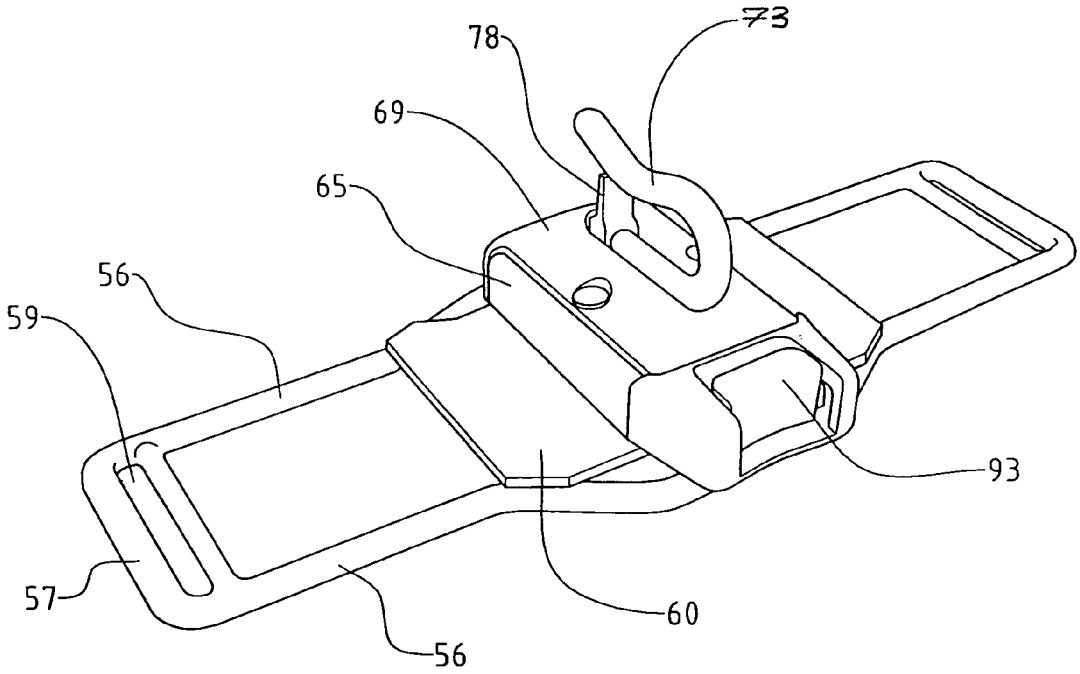
FIG. 11 is a perspective view from the front and above of the fitting illustrated in FIG. 10.
Figure 12:
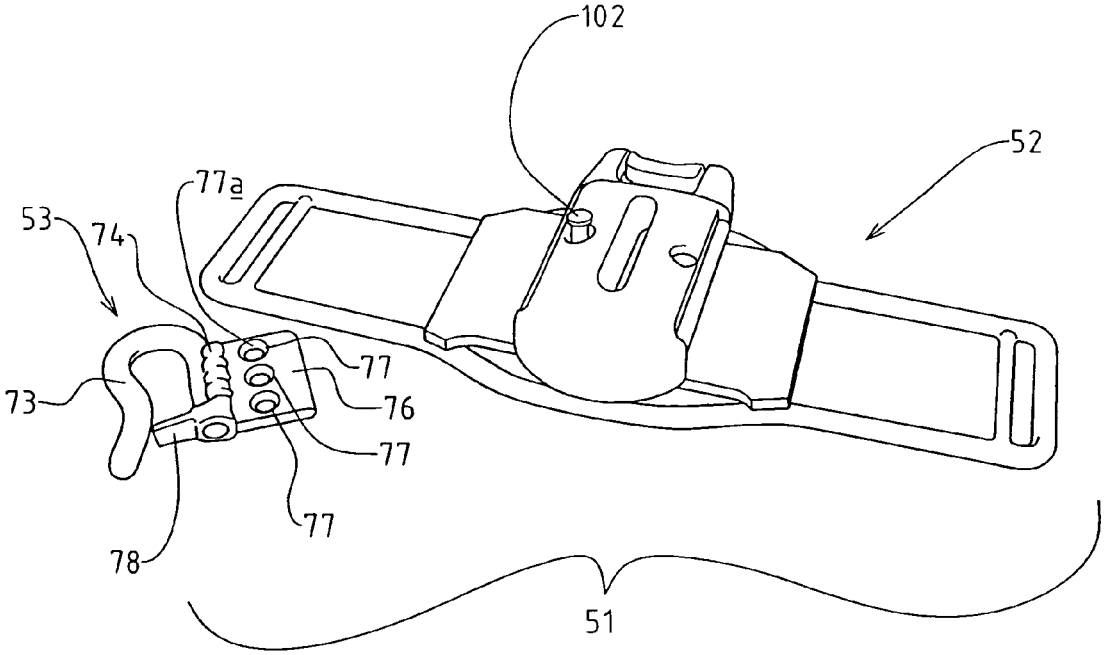
FIG. 12 is a view corresponding generally to that of FIG. 10, illustrating two connectable parts of the fitting separated from one another.

Turning now to FIGS. 10 to 12, there is illustrated a fitting 51 in accordance with a second embodiment of the present invention. As will be apparent from FIG. 12 in particular, the fitting 51 again comprises two main parts 52, 53 which are releasably connectable to one another. FIG. 12 illustrates the two main parts 52, 53 in a condition in which they are released and separate from one another, whilst FIGS. 10 and 11 illustrate the two main parts 2, 3 connected to one another.

The first part 52 of the fitting again comprises an elongate frame 54 which defines a pair of outwardly-directed arms 55, each of which has a generally rectangular configuration and comprises a pair of outwardly-directed bar portions 56 which are interconnected by a respective terminal bar portion 57. Spaced slightly inwardly from each terminal bar portion 57, there is provided a securing bar 58 which extends between the two bar portions 56 of each arm 55. Each securing bar 58 is welded at each end to a respective bar portion 56. An elongate slot 59 is thus defined between the terminal bar portion 57 and the securing bar 58 of each arm 55. A generally rectangular base plate 60 is mounted centrally on the frame 54, and is secured thereto by four welds 61 in the corner regions of the base plate 60.

Figure 13:
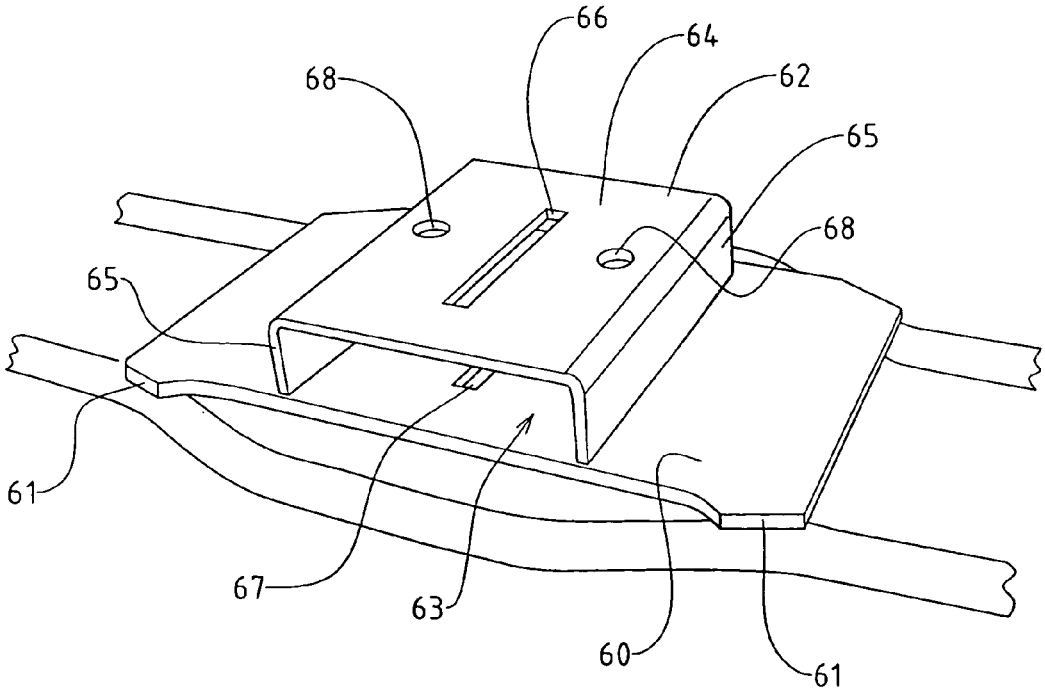
FIG. 13 is a perspective view of a region of one of the parts illustrated in FIG. 3, showing a component removed.

Turning briefly to consider FIG. 13, it will be seen that a metal plate 62 which is bent into a generally U-shaped configuration is secured, again by welding, to the base plate 60 so as to define an elongate channel 63 of substantially rectangular cross-section, the channel 63 comprising a front wall 64 and a pair of opposed side walls 65. The front wall 64 of the channel 63 is provided with an elongate rectangular slot 66 therethrough which is aligned with a substantially identical slot 67 provided through the base plate 60. A pair of opposed and aligned circular apertures 68 are provided through the front wall 64, on opposite sides of the elongate rectangular slot 66.

Figure 14:
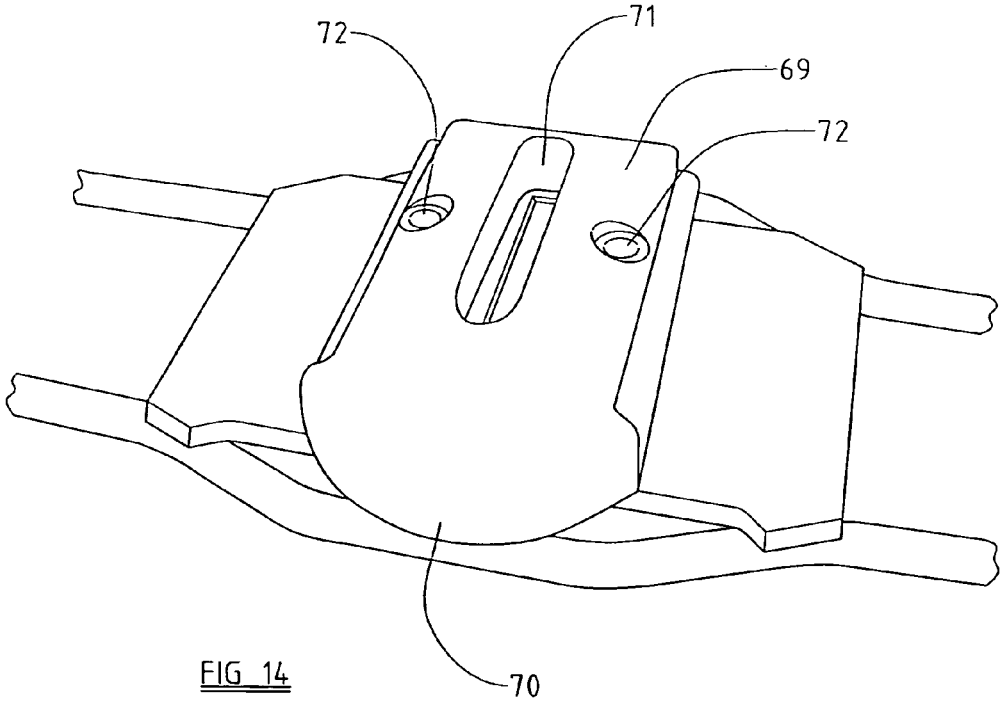
FIG. 14 is a view corresponding generally to that of FIG. 13, but illustrating the arrangement with an additional component.

The rectangular channel 63 encloses a locking mechanism which will be described in more detail hereinafter. However, turning briefly to consider FIG. 14, it will be seen that a plastic moulding 69 is releasably clipped to the front wall 64 of the channel 63. The plastic moulding 69 has a rounded bottom end 70 which is configured to close or plug the lower end of the channel 63. However, the upper end of the channel 63 is left open. An elongate slot 71 is provided through the plastic moulding 69, the elongate slot 71 being aligned with and slightly larger than the elongate slot 66 provided through the front wall 64 of the channel 63. Similarly, a pair of circular apertures 72 are provided through the plastic moulding 69 which are aligned with the respective apertures 68 when the plastic moulding 69 is clipped to the front wall 64.

Having regard to FIG. 12, it will be seen that the second part 53 of the fitting 51 comprises a hook 73 bent from a length of metal bar and secured, by a weld 74, to a rectangular flat plate 76. Three aligned circular locking apertures 77 are provided through the flat plate 76. The edge of each locking aperture 77 defines a circular locking seat 77*a*, the purpose of which is largely similar to that of the circular seats 29*a* of the previously-described embodiment, but which will be described in more detail hereinafter.

Also illustrated in FIG. 12, is a small plastic retaining clip 78 which extends from the region of the flat plate 76 to the end region of the hook 73. The retaining clip 78 serves to prevent accidental or inadvertent disengagement of the hook 73 from a tether line such as a trapeze wire. Also, as will become clear, if the second part 53 of the fitting 51 becomes released from the first part 52, then the retaining clip 58 ensures that the second part 53 remains attached to the end of the trapeze wire.

As indicated above, the channel 63 provided on the base plate 60 has a locking mechanism. The locking mechanism will be now be described, in more detail, with reference to FIGS. 15 to 18.

Figure 15:
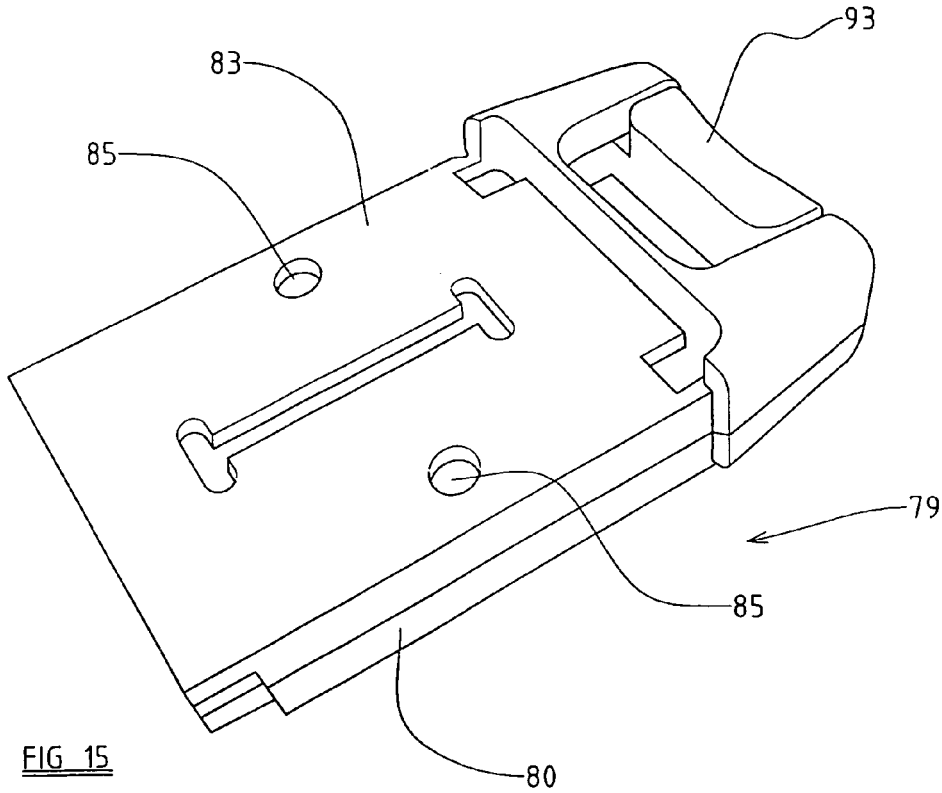
FIG. 15 is a perspective view of a locking mechanism of the second embodiment of the invention.

As illustrated in FIG. 15, the locking mechanism 79 takes the form of a generally rectangular cartridge 80 which is sized to be received within the rectangular channel 63 as illustrated generally in FIGS. 10 to 12.

Figure 16:
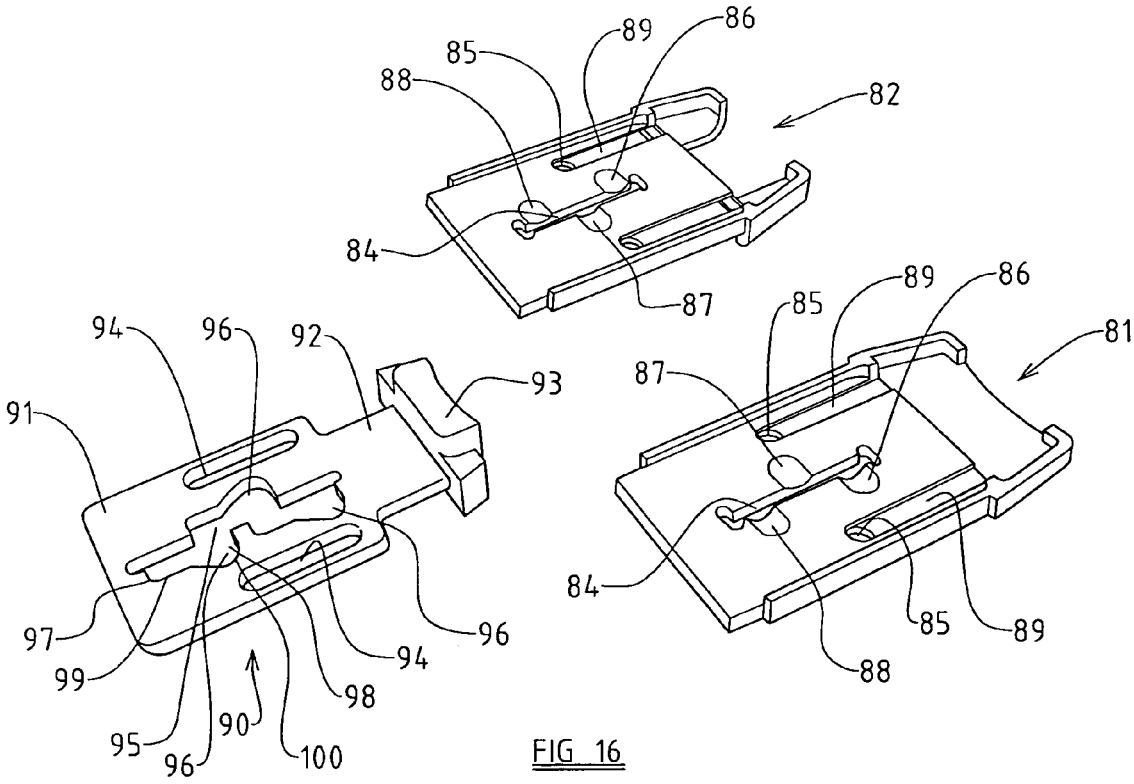
FIG. 16 is a perspective view of three component parts of the locking mechanism illustrated in FIG. 15.

The cartridge 80 comprises a pair of plastic mouldings 81,82 as illustrated in FIG. 16, which together define the cartridge 80 when positioned against one another as illustrated in FIG. 15. Each cartridge moulding 81,82 has a generally rectangular configuration and has a planar outer surface 83.

Each cartridge moulding 81,82 is provided with an elongate slot 84 therethrough, and a pair of circular apertures 85 therethrough. Each cartridge moulding 81,82 is also provided with three recesses 86, 87 and 88 at positions adjacent the elongate slots 84. On each cartridge moulding 81, 82 the recesses 86, 88 are provided at respective ends of the slot 84, and on the same side of the slot 84 as one another. In contrast, on each cartridge component 81, 82, the recess 87 is provided in the central region of the slot 84 and on the opposite side of the slot 84 to the recesses 86, 88. The recesses 86, 87, 88 of each cartridge moulding 81, 82 are configured so that when cartridge component 82 is overturned from its position illustrated in FIG. 16 and is aligned with and positioned against the other cartridge component 81, then the two recesses 86 of each cartridge moulding will be aligned, as will the two recesses 87, and the two recesses 88 of each cartridge moulding 81, 82. It will therefore be appreciated that when the cartridge moulding 82 illustrated in FIG. 16 is overturned and aligned with the other cartridge moulding 81, then the recesses 86, 87 and 88 define respective channels.

Extending away from each apertures 85, there are provided respective elongate recessed channels 89.

As will become clear hereinafter, the cartridge mouldings 81, 82 serve to house the operative parts of the locking mechanism 79, one of which is a locking element 90. The locking element 90 comprises a generally rectangular metal plate 91 which is provided with an extension 92 at one end which carries an actuating button 93.

A pair of elongate slots 94 are provided through the rectangular plate 91 in the regions of respective longitudinal side edges of the plate 91. A more elaborate shaped slot 95 is provided through the central region of the rectangular plate 91.

The central slot 95 defines three recesses 96, each of which has a generally "pear" shape so as to define respective first and second recess portions 97, 98. Each first recess portion 97 defines a straight edge 99, and each second recess portion 98 defines a ramp surface 100.

Figure 17:
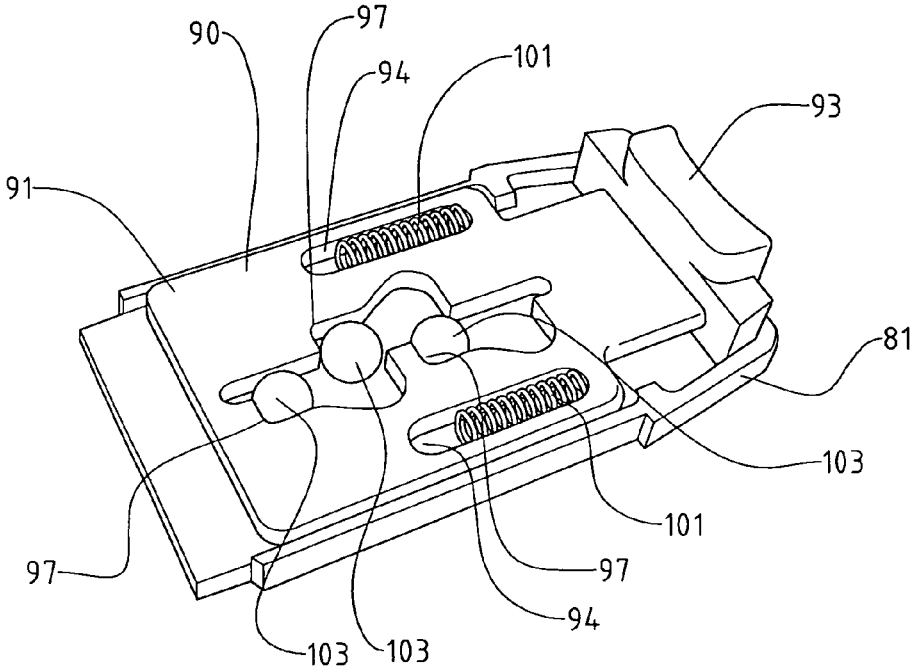
FIG. 17 is a view corresponding generally to that of FIG. 15, but illustrating one component part of the mechanism removed so that the operative parts of the mechanism are visible.

Turning now to consider FIG. 17, the locking element 90 is illustrated in position against the first cartridge moulding 81. In this position, it will be seen that each elongate slot 94 provided through the rectangular plate 91 is aligned over a respective recessed channel 89 of the cartridge moulding 81. A spring 101 is received within each elongate slot 94 so as to sit within a respective channel 89. When the cartridge 80 is fully assembled as shown in FIG. 15, the locking element 90 is slidably received between the two cartridge mouldings 81, 82. The fully assembled cartridge 80 is thereafter slidably received within the rectangular channel 63 as illustrated most clearly in FIG. 12. In this position, the cartridge 80 is retained in position by a pair of retaining pins 102 (only one of which is illustrated in FIG. 12) which extend through the aligned apertures 72, 68 and 85. The retaining pins 102 thus pass through the end region of each elongate slot 94 and it will therefore be understood, by returning to FIG. 17, that each spring 101 thus bears against a respective retaining pin 102 when the locking mechanism is fully assembled. The opposite end of each spring 101 bears against the end of its respective elongate slot 94. It will therefore be understood that each spring 101 serves to bias the locking element 90 towards the locking position illustrated in FIG. 17.

It will be seen from FIG. 17, that in its locking position, the locking element 90 is positioned such that the first recess portions 97 are each aligned with a respective recess 86, 87, 88 of the cartridge mouldings 81, 82.

Received within each recess 86, 87, 88 is a respective locking member which, in the arrangement illustrated, takes the form of a ball 103. Each ball 103 is sized such that when the locking element 90 is positioned in its locking position shown in FIG. 17, each ball 103 engages a respective straight edge 99 of the first recess portions 97, but extends at least partially across the elongate slots 84 provided through the two cartridge mouldings 81, 82.

As indicated above, when the components illustrated in FIG. 17 are assembled as shown, the other cartridge moulding 82 can be positioned over the first cartridge moulding 81 such that the locking element 90, the springs 101 and the balls 103 are all located between the two cartridge mouldings 81, 82 as illustrated in FIG. 15.

The locking mechanism 79, when assembled as illustrated in FIG. 15 is then inserted into the channel 63 provided on the first part 52 of the fitting 51. The cartridge 80 of the locking mechanism 709 is sized to be a close sliding fit within the channel 63 and so may be inserted into the channel from the top end. As indicated above, when the cartridge 80 is fully inserted into the channel 63, the apertures 85 through the cartridge 80 become aligned with the apertures 68 through the front plate 64 of the channel 63 and with the aperture 72 provided through the plastic moulding 69. The retaining pins 102 can thus be inserted through all of the aligned apertures and into the slots 94 provided through the locking element 90, so as to engage the ends of the springs 101.

Returning briefly to consider FIG. 10, the fitting 51 of the second embodiment is illustrated with the second part 53 of the fitting engaged by the locking mechanism 79 of the first fitting 52. In this configuration, the flat plate 76 is inserted through the slot 71 provided in the plastic moulding 69, and through the slot 66 provided in the front wall 64 of the channel 63. The flat plate 76 is thus received within the slots provided in the locking cartridge 80. Each locking aperture 77 is aligned with respective locking ball 103 such that each locking ball 103, being urged inwardly across the slot provided through the locking cartridge 80, engages a respective peripheral seat 77*a*, in order to releasably lock the second component 53 in position relative to the first component 51.

Figure 18:
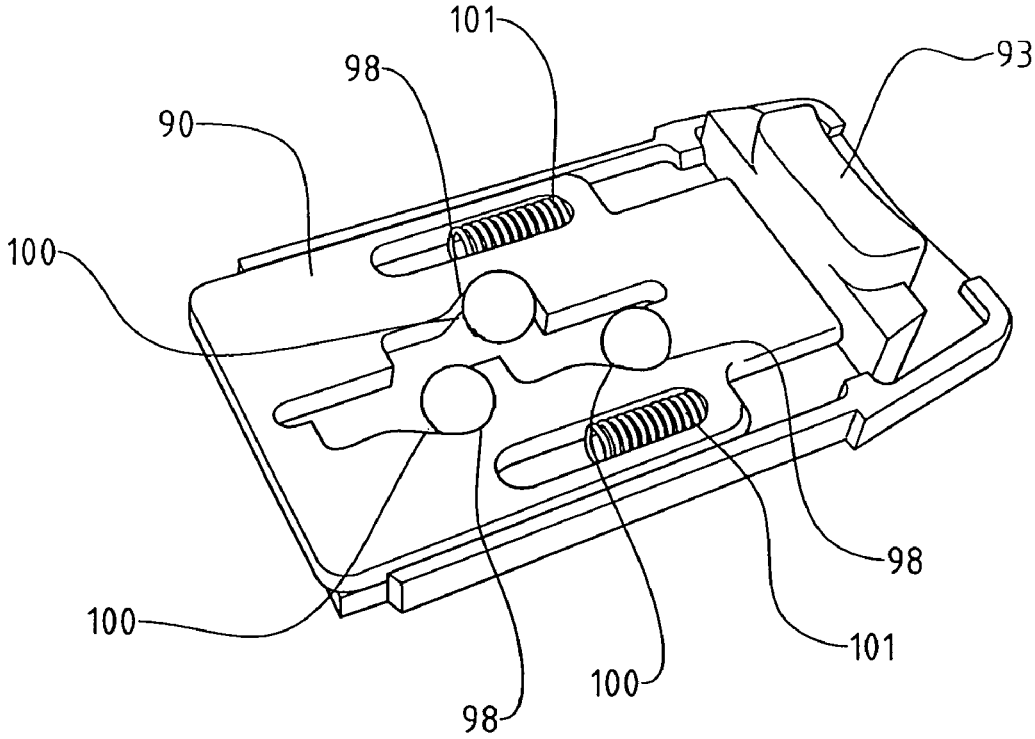
FIG. 18 is a view corresponding generally to that of FIG. 17, illustrating parts of the mechanism in an alternate position.

However, when the actuating button provided on the locking element 90 is depressed, as illustrated most clearly in FIG. 18, it will be seen that the locking element 90 is moved from its locking position illustrated in FIG. 17 to the release position illustrated in FIG. 18, against the bias of the two springs 101. In this position, it will be seen that the second recess portions 98 become aligned with respective recesses 86, 87, 88 provided on the cartridge components 81, 82 and so the locking balls 103 sitting within the recesses 86, 887, 88 are free to move into the larger second recess portions 98, hence moving away from the slots provided through the cartridge mouldings 81, 82 and hence moving out of engagement with the peripheral seat 77*a* of the locking aperture 77. If force is applied to the second part 53 of the fitting 51, so as to pull the second part 53 away from the first part 52, movement of the plate 76 out of the slot tends to push the locking balls 103 outwardly into their respective release positions illustrated in FIG. 18 in which they are received within respective second recess portions 98. The second part 53 of the fitting 51 thus becomes released from the first part 52.

As will be appreciated, subsequent release of the actuating button 93 allows the locking element 90 to move back to its locking position illustrated in FIG. 17. As the locking element 90 moves towards the locking position illustrated in FIG. 17, the ramp surfaces 100 bear against the locking balls 103 which are constrained for only transverse movement relative to the slots 84 provided through the bottom cartridge, and hence the locking balls 103 are again urged inwardly towards their locking positions illustrated in FIG. 17, in which part of each locking ball 103 extends at least partially across the slots 84. Thus, if it is required to re-connect the second part 53 of the fitting to the first part 52, then the actuating button 93 can be held in a depressed condition whilst the plate 76 is re-introduced into the slots 84, whereafter the actuating button 93 can be released thus urging the locking balls 103 back into engagement with the peripheral seat 77*a* of each locking aperture 77.

It is to be appreciated that certain modifications could be made to the above-described embodiment, without departing from the scope of the invention. For example, it is envisaged that only two locking locking balls 103 could be provided in the two recesses 96 which are located on the same side of the slot through the plate 91. In such an arrangement, the central recess 96 located on the opposite side of the slot can be eliminated. The arrangement would thus operate such that the two balls 103 move in the same direction, parallel to one another, as the actuating button 93 is pressed.

Figure 19:
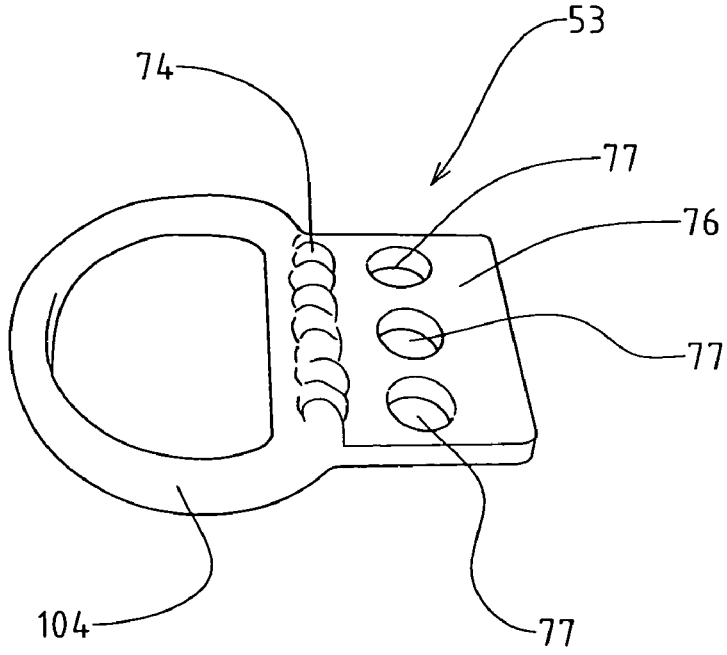
FIG. 19 is a perspective view of an alternative configuration of one of the two connectable parts of the second embodiment of the invention.

FIG. 19 illustrates an alternative configuration for the second component part 53 of the embodiment of the fitting described above with reference to FIGS. 10 to 18. The alternative configuration for the second component part 53 illustrated in FIG. 19 again comprises a substantially flat plate 76 having three locking apertures 77 provided therethrough, but the locking plate 76 is instead connected, by a weld 74, to a closed loop 104 defined by a length of bent metal bar. The closed loop 104 replaces the bent hook 73 of the arrangement disclosed above and provides an alternative arrangement for connection to the end of a tether line such as, for example, a trapeze wire.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A fitting for a harness, the fitting comprising: a first part secured to or securable to a harness, a second part connectable to a tether, and a mechanism to releasable interconnect the first and second parts, one of said parts having a plurality of locking apertures and said mechanism comprising a plurality of locking members each having a rounded or tapered locking part sized to be received within a respective said locking aperture; and a locking element moveable between a locking position and a release position, the locking element being configured to urge each locking member into a position in which its locking part is received within a respective said locking aperture when in said locking position but to allow each locking member to move out of said respective locking aperture when in said release position, wherein each said locking aperture defines a respective peripheral seat, and the rounded or tapered locking part of each said locking member is sized to engage a respective said seat when urged into said respective locking aperture but not to pass completely through said seat and wherein the locking element is arranged to urge at least two of said locking members towards one another in order that their locking parts become received within respective said locking apertures.

2. A fitting for a harness, the fitting comprising: a first part secured to or securable to a harness a second part connectable to a tether, and a mechanism to releasable interconnect the first and second parts, one of said parts having a plurality of locking apertures and said mechanism comprising:

a plurality of locking members each having a rounded or tapered locking part sized to be received within a respective said locking aperture; and a locking element moveable between a locking position and a release position, the locking element being configured to urge each locking member into a position in which its locking part is received within a respective said locking aperture when in said locking position but to allow each locking member to move out of said respective locking aperture when in said release position, wherein each said locking aperture defines a respective peripheral seat, and the rounded or tapered locking part of each said locking member is sized to engage a respective said seat when urged into said respective locking aperture but not to pass completely through said seat, wherein the locking element is arranged to urge at least two of said locking members towards one another in order that their locking parts become received within respective said locking apertures, and, wherein three locking apertures are provided, and three locking members are provided, two of said locking members being arranged to move in the same direction as one another towards respective locking apertures.

* * * * *

UNITED STATES PATENT AND TRADEMARK OFFICE

CERTIFICATE OF CORRECTION

PATENT NO. : 7,346,966 B2
APPLICATION NO. : 10/784137
DATED : March 25, 2008
INVENTOR(S) : Steven R. Atkins et al.

It is certified that error appears in the above-identified patent and that said Letters Patent is hereby corrected as shown below:

Column 12, line 66, delete “releasable” and insert --releaseably--.

Column 13, line 25, delete “releasable” and insert --releaseably--.

Signed and Sealed this

Twelfth Day of August, 2008

JON W. DUDAS
*Director of the United States Patent and Trademark Office*